United States Patent [19]

Quintile

[11] Patent Number: 5,033,793

[45] Date of Patent: Jul. 23, 1991

[54] EXTENDABLE ELEVATING LEG REST FOR A WHEELCHAIR

[75] Inventor: Mark J. Quintile, Brunswick, Ohio

[73] Assignee: Invacare Corporation, Elyria, Ohio

[21] Appl. No.: 501,049

[22] Filed: Mar. 29, 1990

[51] Int. Cl.[5] ..... A47C 7/50

[52] U.S. Cl. ..... 297/433; 297/DIG. 4; 297/436; 74/98; 74/109

[58] Field of Search ..... 297/423, 433–435, 297/DIG. 4, 429, 436, 375; 74/98, 109

[56] References Cited

U.S. PATENT DOCUMENTS 453,237 6/1891 Goodwin ..... 297/433

4,486,048 12/1984 Meyer ..... 297/423

*Primary Examiner*—Kenneth J. Dorner

*Assistant Examiner*—Milton Nelson, Jr.

*Attorney, Agent, or Firm*—Fay, Sharpe, Beall, Fagan, Minnich & McKee

[57] ABSTRACT

An extendable elevating leg rest assembly for a wheelchair includes a support tube connected to the wheelchair. A first gear member is fixed to the support tube. An extendable strut, which includes a hollow upper strut member pivotally connected to the first gear member and a lower strut member slidably received in the upper strut member, pivots about the first gear member between a lowered position and an elevated position. An adjustable foot rest assembly is releasably clamped to the lower strut member. The leg rest assembly also includes a mechanism for extending the foot rest in reaction to the strut being pivoted toward the elevated position. The extending mechanism includes a second gear member, a drive link, and a follower link. The second gear member is rotatably mounted on the upper strut member and is in meshing engagement with the first gear member so that the second gear member rotates when the strut is povited about the first gear member. The drive link has a fixed end fixed to the second gear member and a free end pivotally connected to one end of the follower link. The other end of the follower link is connected to the lower strut member. When the strut is pivoted from the lowered position to the raised position, the second gear member is caused to rotate, which pivots the drive link. Pivoting the drive link causes the follower link to extend the lower strut member out of the upper strut member.

26 Claims, 5 Drawing Sheets

3
3
52
53
38
36
20
78
C
α2
72
32a
64
24
26
72
29
80
76
α1
29
22
12
18
27
78
C
82
84
56
50
32b
46
38
53
55
52
32
36
48
44
64
74
34
27
53
38
84
36
34
24
66
B
A
40
26
27
28
30
78
72

FIG. 6
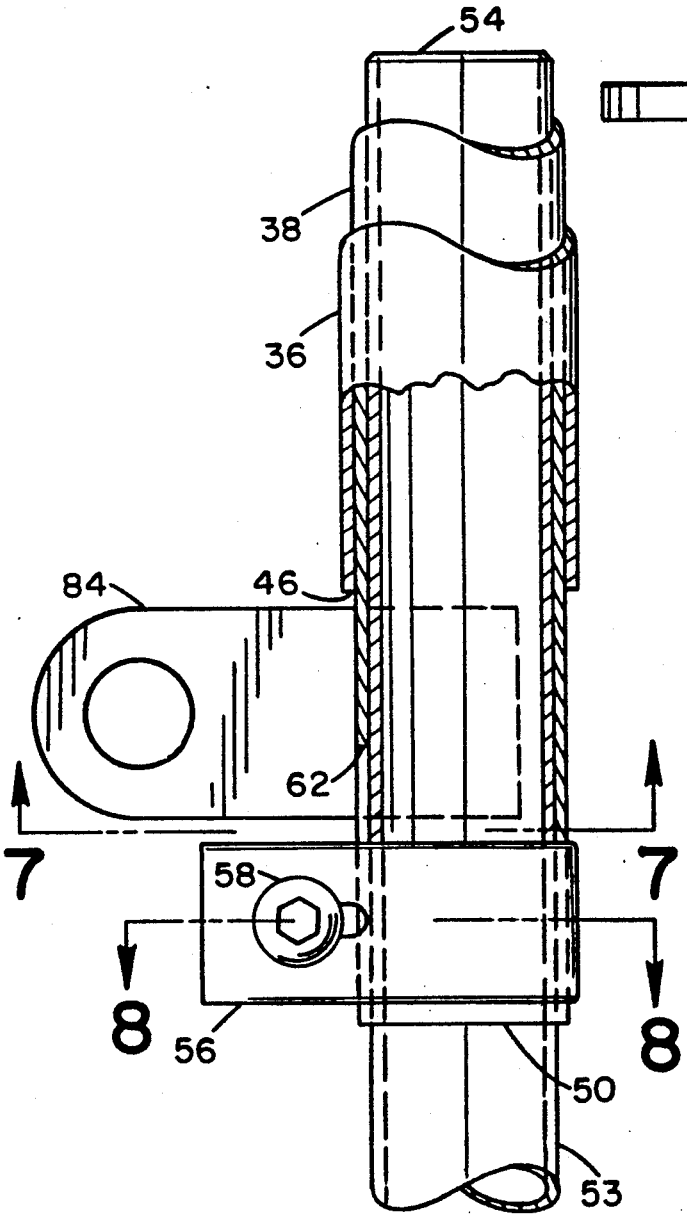
FIG. 7
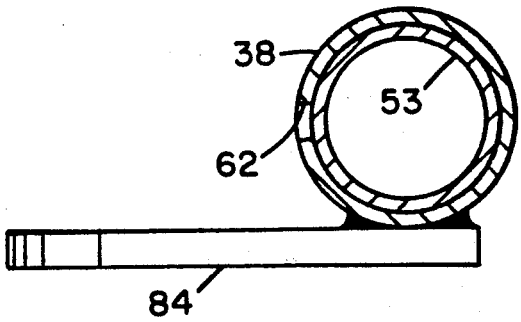
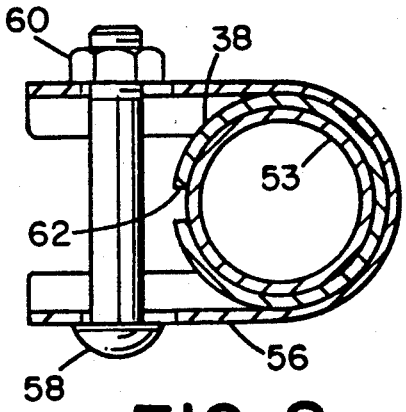
FIG. 8

EXTENDABLE ELEVATING LEG REST FOR A WHEELCHAIR

BACKGROUND OF THE INVENTION

The present invention relates to leg rests for wheelchairs. In particular, the present invention relates to wheelchair leg rests that automatically extend in length when being elevated.

Conventional wheelchairs typically have leg rests that can be pivoted upwardly to a substantially horizontal disposition. The ability to raise the leg rests is important, for example, because it often is desirable for therapeutic reasons to be able to elevate the patient's foot from time to time.

In conventional wheelchair structures, the leg rest is pivotally connected at its upper end to the wheelchair frame adjacent the front edge of the seat bottom, and a foot rest is located at the lower end of the leg rest. The foot rest normally is mounted on a shaft that is inserted into the lower end of the leg rest and secured by a clamp. The shaft telescopes within the leg rest to enable the location of the foot rest to be adjusted to a position that supports the patient's foot when the patient's leg is in the normal, lowered position.

Because the pivot point of a conventional leg rest does not coincide with the pivot point of the knee of the patient seated in the wheelchair, the foot rest tends to push upwardly on the bottom of the patient's foot when the leg rest is elevated. As a result, raising the leg rest exerts unwanted compression on the patient's knee and/or causes the knee to be lifted.

A number of attempts have been made to compensate for the eccentricity between the knee joint and the conventional wheelchair leg rest. In the structure shown in U.S. Pat. No. 3,072,437, for example, the leg rest assembly is connected to the wheelchair through a pair of horizontally telescoping struts, which enable the entire leg rest to be translated horizontally away from the wheelchair when the leg rest is raised. The horizontal movement of the leg rest assembly, however, is accomplished by the patient's foot forcing the assembly to move away from the wheelchair as the leg rest is being raised. For certain patients this exerts unwanted pressure on the leg.

In another attempt, shown in U.S. Pat. No. 4,486,048, the leg rest is a telescoping strut pivoting about a leg rest pivot located on a horizontal mounting arm. An actuating lever is connected between the lower member of the strut and a second pivot point disposed on the mounting arm forwardly from the leg rest pivot. Raising the leg rest causes the lower strut member to extend automatically. Although this mechanism operates without exerting unwanted pressure on the patient's leg, the positioning of its actuating lever near the pivot point for the leg rest creates a potential safety hazard. When the leg rest is in the lowered position, the leg rest, actuating lever, and mounting arm form an open triangle. When the leg rest is raised, the triangle closes as the angle between the mounting arm and actuating lever approaches zero. At the least, the patient's clothing can get caught in the closing triangle. More importantly, the actuating structure can pinch the skin or catch the fingers of the patient or attendant as the leg rest is being raised.

The present invention is intended to provide an improved wheelchair leg rest that extends automatically when raised.

The present invention is intended to provide a wheelchair leg rest that extends automatically when raised while minimizing the risk of clothing or hands becoming caught in the extending mechanism.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art extendable leg rests by providing a telescoping leg rest that is extended by enmeshed gears and a link mechanism in reaction to the leg rest being raised.

To overcome the problems of the prior art extendable wheelchair leg rests, and in accordance with the purpose of the invention, as embodied and broadly described herein, the extendable elevating leg rest assembly of this invention comprises a first gear member having a first gear axis and a plurality of first gear teeth arranged circumferentially around the first gear axis, mounting means for mounting the first gear member on the wheelchair, and an extendable strut pivotable about the first gear axis between a lowered position and an elevated position. The mounting means prevents the first gear member from rotating about the first gear axis. The strut includes a proximal end pivotally connected to the first gear member and a distal end. The leg rest assembly also comprises a foot rest connected to the strut at the distal end thereof and extending means, engageable with the first gear member, for extending the foot rest in reaction to the strut being pivoted toward the elevated position.

The extending means preferably includes a second gear member and link means connected between the second gear member and the strut for increasing the distance between the proximal end and the distal end of the strut as the strut is pivoted toward the elevated position. The second gear member, which has a second gear axis and a plurality of second gear teeth arranged circumferentially around the second gear axis, is rotatably mounted on the strut proximate the proximal end thereof. The second gear teeth are in meshing engagement with the first gear teeth of the first gear member so that the second gear member rotates about the second gear axis when the strut is pivoted relative to the mounting means.

The link means preferably includes a drive link and a follower link. The drive link has a fixed end fixed to the second gear member and a free end. The follower link has a first end pivotally connected to the drive link proximate the free end thereof and a second end pivotally connected to the strut proximate the distal end thereof.

The extendable strut preferably includes a generally U-shaped gear cover pivotally connected to the first gear member, a hollow upper strut member having a first end fixed to the gear cover and an open second end, and a lower strut member having a first end received in the upper strut member through the open second end of the upper strut member. The lower strut member also has an open second end, to which the foot rest is connected. The upper and lower strut members are slidable relative to each other to vary the distance between the first end of the upper strut member and the second end of the lower strut member. The follower link is pivotally connected to the lower strut member proximate its second end.

The accompanying drawings, which are incorporated in and which constitute a part of this specification, illustrate at least one embodiment of the invention and, together with the description, explain the principles of the invention.

BRIEF DESCRIPTION OF THE DRAWINGS

FIG. 6 is a partially cut away view of the lower portion of the leg rest assembly of the present invention;

FIG. 7 is a cross sectional view taken along line 7—7 of FIG. 6;

FIG. 8 a cross sectional view taken along line 8—8 of FIG. 6.

DESCRIPTION OF THE PREFERRED EMBODIMENT

Reference now will be made in detail to the presently preferred embodiment of the invention, an example of which is illustrated in the accompanying drawings.

Figure 1:
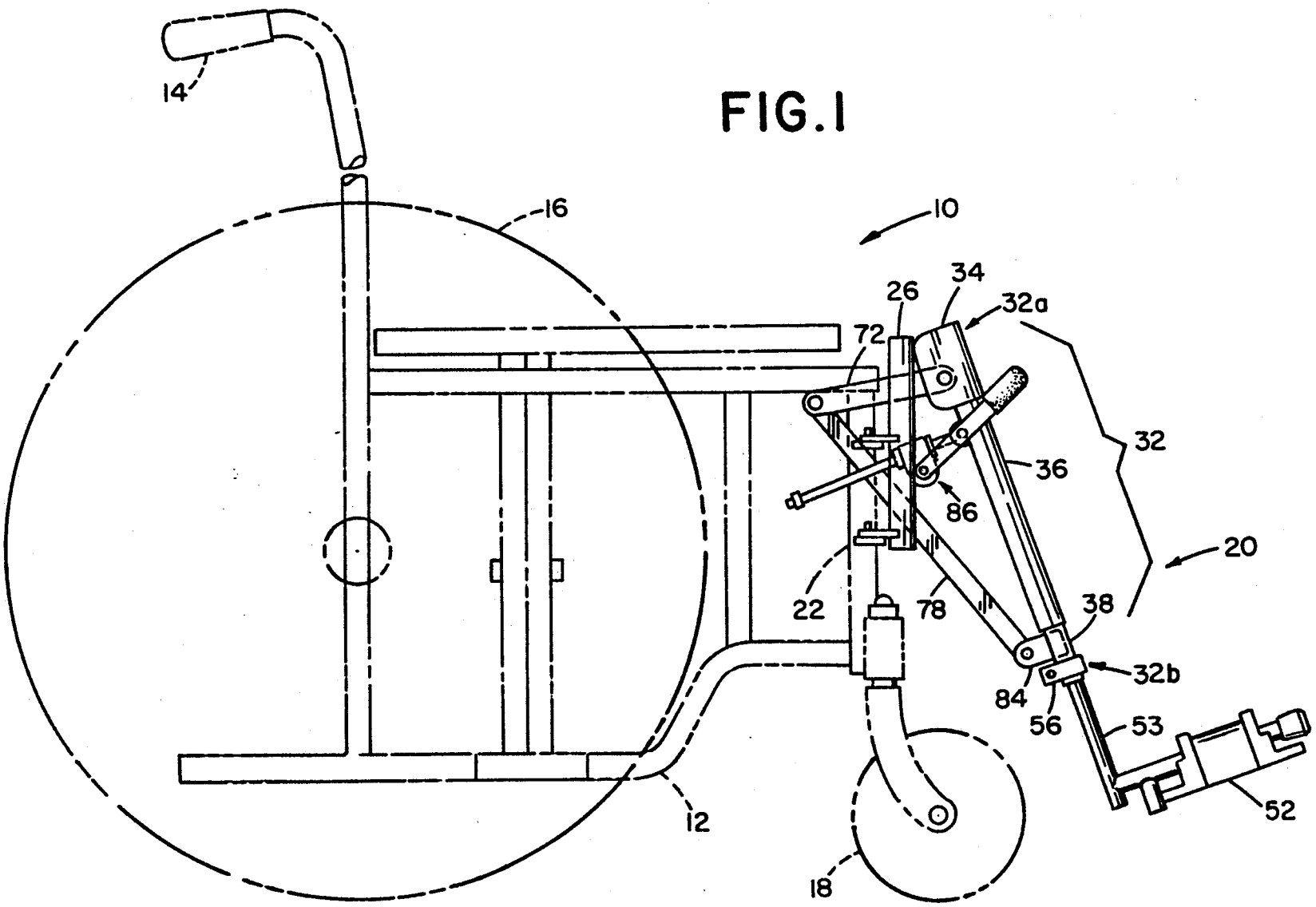
FIG. 1 is a side elevation of a wheelchair including the leg rest assembly of the present invention.

FIG. 1 is a side elevation view of a wheelchair, designated generally by reference numeral 10, that incorporates an embodiment of the extendable elevating leg rest assembly of the present invention. Wheelchair 10 includes tubular frame 12, a pair of rear handles 14 for use by an attendant pushing the wheelchair, a pair of rear driving wheels 16, and a pair of swivelable front wheels 18. In the view presented by FIG. 1, only the right-side handle 14, rear wheel 16, and front wheel 18 are shown.

In accordance with the invention, each side of wheelchair 10 includes an extendable elevating leg rest assembly, designated generally by reference numeral 20. In the embodiment shown in FIGS. 1 and 2, right-side leg rest assembly 20 is mounted on vertically disposed tubular frame member 22. As will be readily apparent to those of ordinary skill in the art, the apparatus disclosed herein can be adapted to be mounted on wheelchair frames having configurations other than that shown in the drawings.

Figures 2, 3:
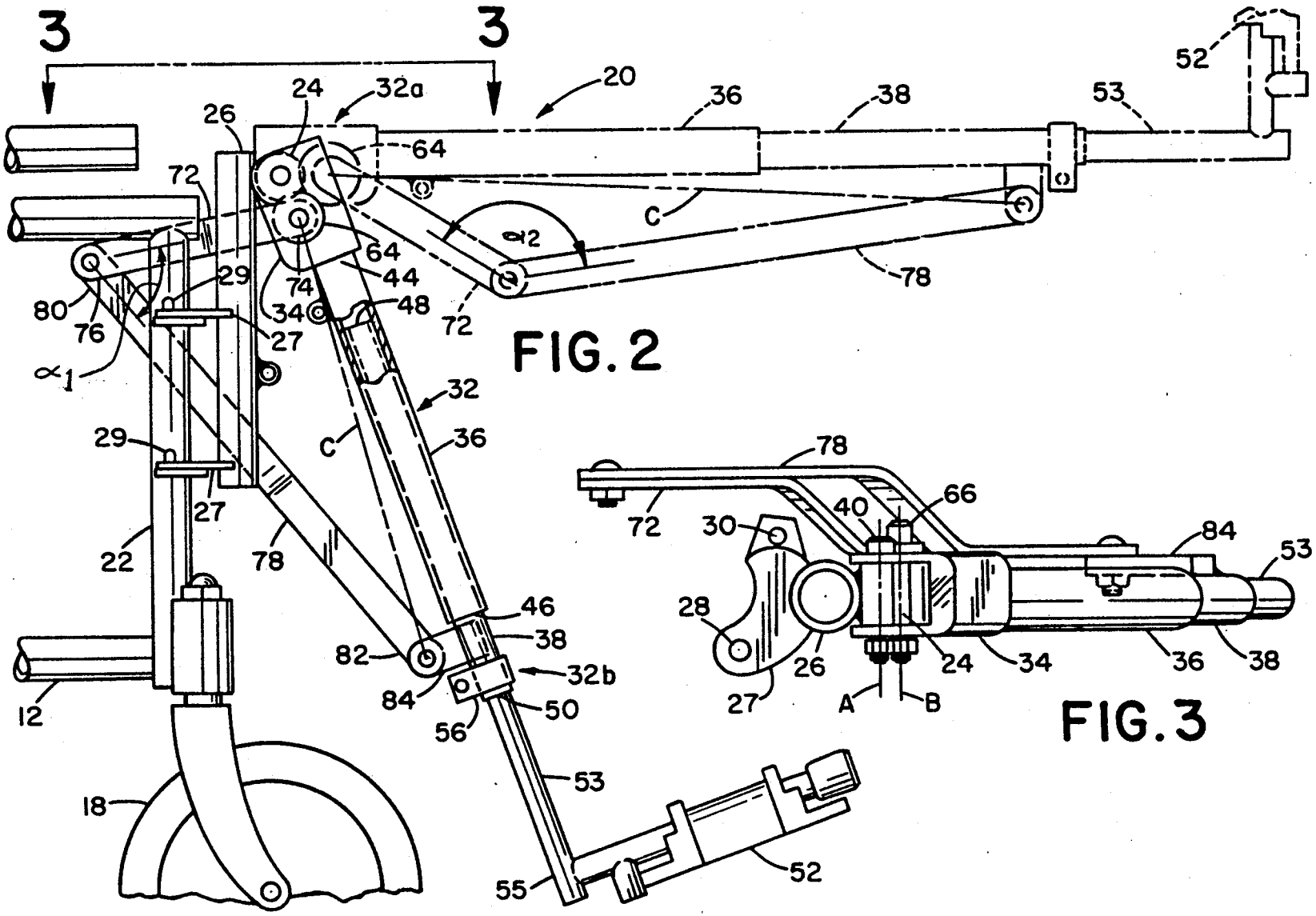
FIG. 2 is detail view of the leg rest assembly of the present invention.
FIG. 3 is a view of the leg rest assembly of the present invention taken along line 3—3 of FIG. 2.
Figure 4:
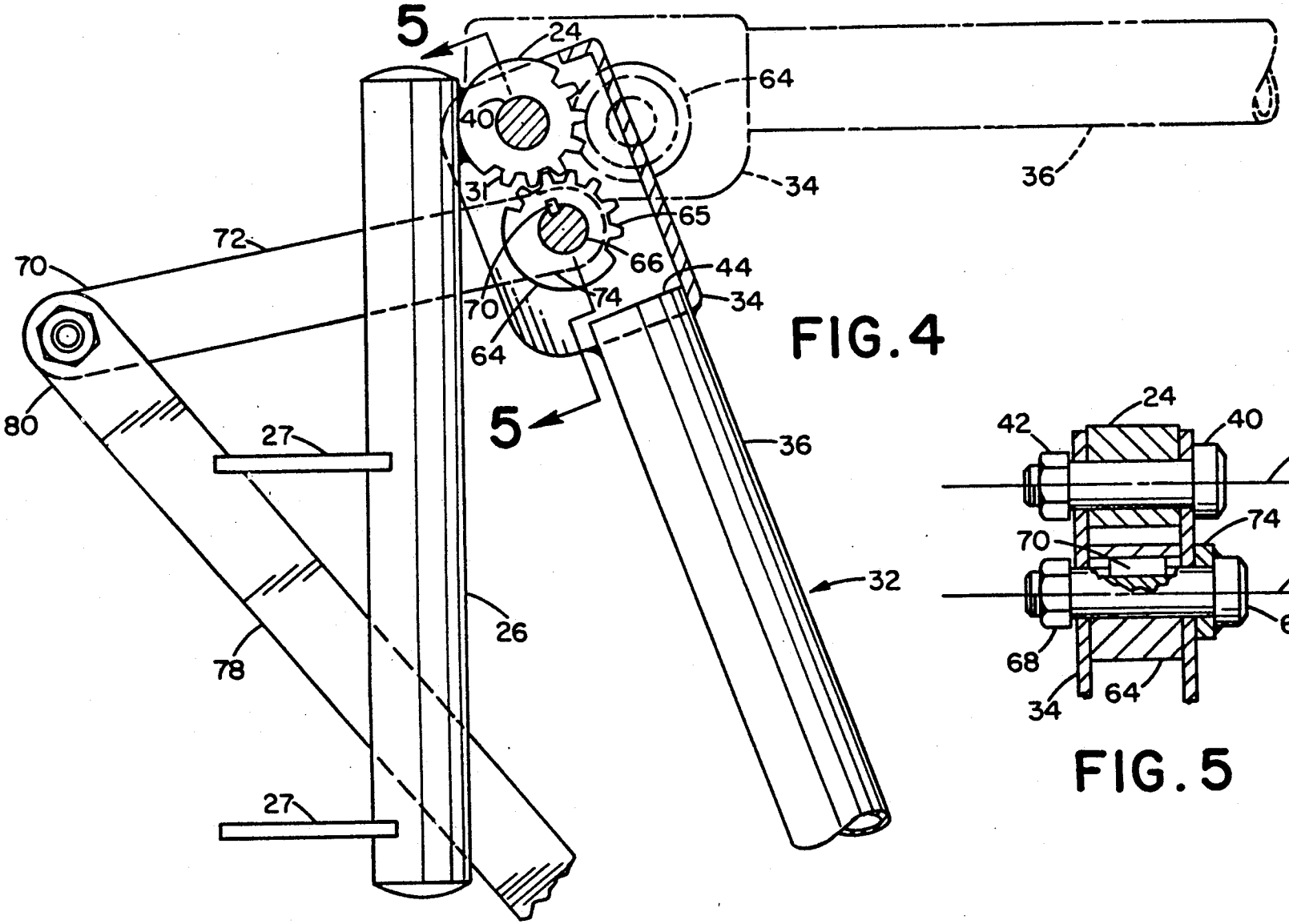
FIG. 4 is a partially cut away view of the upper portion of the leg rest assembly of the present invention.

In accordance with the invention, leg rest assembly 20 includes first gear member 24 and mounting means for mounting the first gear member on the wheelchair. As embodied herein and as shown in FIGS. 2–4, the mounting means of the present invention includes support tube 26. Support tube 26 preferably is disposed vertically and includes a pair of hinge plates 27, which include pivot holes 28 (one of which is shown in FIG. 3) that pivotally engage vertical pins 29 fixed to front frame member 22. Support tube 26 and leg rest assembly 20 are able to swing laterally outwardly along a swing axis defined by pins 29 to facilitate the patient's ingress to and egress from wheelchair 10. Locking holes 30 in hinge plates 27 (see FIG. 3) engage a locking mechanism (not shown) mounted on frame member 22 when the leg rest assembly is in its normal, forward position.

Figure 5:
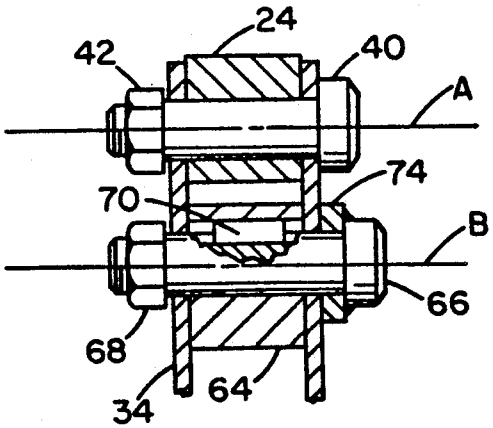
FIG. 5 is a cross sectional view taken along line 5—5 of FIG. 4.

With reference to FIGS. 3–5, first gear member 24 preferably is fixed to the upper end of support tube 26 by welding so that first gear axis A of gear member 24 is disposed generally horizontally and gear member 24 is prevented from rotating about axis A. When support tube 26 is mounted on frame member 22, first gear member 24 is disposed adjacent the front edge of the seat bottom (not shown) of the wheelchair, generally behind the knee of a patient sitting in the wheelchair. First gear member 24 includes a plurality of first gear teeth 31 arranged circumferentially around first gear axis A. First gear teeth 31 preferably extend around only a portion of the circumference of gear member 24. The toothed portion of first gear member 24 preferably is defined by an arc of about 180° centered at first gear axis A.

In accordance with the invention and as shown in FIG. 2, leg rest assembly 20 includes an extendable strut, generally designated by reference numeral 32. Strut 32 includes a proximal end, designated generally by reference numeral **32*a*, and a distal end, designated generally by reference numeral 32*b*. Proximal end 32*a* is pivotally connected to first gear member 24 so that strut 32 is pivotable between a lowered position (shown by solid lines in FIG. 2) and an elevated position (shown by broken lines in FIG. 2**).

With reference to FIGS. 2–5, strut 32 preferably includes generally U-shaped gear cover 34, upper strut member 36, and lower strut member 38, which is parallel to and coincident with upper strut member 36. As shown in FIG. 5, gear cover 34 is pivotally connected to first gear member 24 by bolt 40 and nut 42. Upper strut member 36 preferably comprises a hollow tube having a first end 44 fixed to gear cover 34 by welding (see FIG. 4) and an open second end 46. Lower strut member 38, which also preferably comprises a hollow tubular member, has a first end 48 received in upper strut member 36 through open end 46 and an open second end 50 at distal end **32*a* of strut 32. Strut members 36 and 38** are slidable relative to one another along their coincident longitudinal axes.

With reference to FIGS. 2, 6, and 8, the leg rest assembly of this invention also includes foot rest 52 and connecting means for adjustably connecting foot rest 52 to the distal end of strut 32. As embodied herein, the connecting means of this invention includes mounting bar 53 having one end 54 (see FIG. 6) slidably received in lower strut member 38 through open end 50 and another end 55 (see FIG. 2) for mounting foot rest 52. The connecting means also includes clamping means for releasably clamping mounting bar 53 to lower strut member 38. As embodied herein, the clamping means of this invention includes generally U-shaped clamp 56 having its two legs connected by bolt 58 and nut 60. Loosening clamp 56 allows for the adjustable positioning of foot rest 52 to correspond to the position of the patient's foot. Lower strut member 38 preferably includes a longitudinal slot 62 formed therein at second end 50 to facilitate the clamping action of clamp 56.

In accordance with the invention, leg rest assembly 20 includes extending means, engageable with first gear member 24, for extending foot rest 52 in reaction to strut 32 being pivoted toward the elevated position. As embodied herein and shown in FIGS. 2–5, the extending means of this invention includes second gear member 64, which has a second gear axis B and includes a plurality of second gear teeth 65 arranged circumferentially around axis B. Second gear teeth 65 preferably extend around only a portion of the circumference of gear member 64. The toothed portion of second gear member 64 preferably is defined by an arc of about 180° centered at second gear axis B.

Second gear member 64 is rotatably mounted to gear cover 34 with axis B disposed horizontally. Second gear teeth 65 of gear member 64 are in meshing engagement with first gear teeth 31 of first gear member 24 so that second gear member 64 rotates about axis B when strut 32 is pivoted about first gear axis A. In the view presented by FIGS. 2 and 4, second gear member 64 rotates in a counterclockwise direction when strut 32 is pivoted toward the elevated position. By providing gear members 24 and 64 with teeth on only a portion of their circumferences, the angle through which strut 32 can pivot can be limited. For example, when gear members 24 and 64 have toothed portions that comprise approximately 180° of their circumferences, the angle between the fully lowered and fully elevated positions of strut 32 is limited to about 70°.

In accordance with the invention, second gear member 64 is rotatably connected to gear cover 34 by bolt 66 and nut 68. Bolt 66 is keyed to second gear member 64 by key member 70 so that bolt 66 rotates about axis B along with second gear member 64 when strut 32 is pivoted about axis A. Gear cover 34 partially encloses gear members 24 and 64 to prevent clothing or fingers from becoming caught between the gear members.

The extending means of the present invention also includes link means connected between second gear member 64 and strut 32 for increasing the distance between proximal end 32*a* and distal end 32*b* of strut 32, and thus extending foot rest 52, as the strut is pivoted toward the elevated position. As embodied herein, the link means of this invention includes drive link 72, which has a fixed end 74 fixed to second gear member 64 and a free end 76. As shown in FIG. 5, the fixed connection of end 74 with gear member 64 preferably is provided by welding end 74 to bolt 66, which is keyed to gear member 64.

The link means further includes follower link 78, which includes a first end 80 pivotally connected to free end 76 of drive link 72 and a second end 82. Second end 82 of follower link 78 is pivotally connected to strut 32 proximate distal end 32*b*. Specifically, second end 82 is pivotally connected to lug 84, which is fixed to lower strut member 38 adjacent open end 50.

As shown in FIG. 3, drive link 72 and follower link 78 are disposed on the inner side of support tube 26 so that the leg rest assembly can swing outwardly about pins 29. In addition, links 72 and 78 preferably are offset laterally to provide clearance around hinge plates 27.

Figure 9:
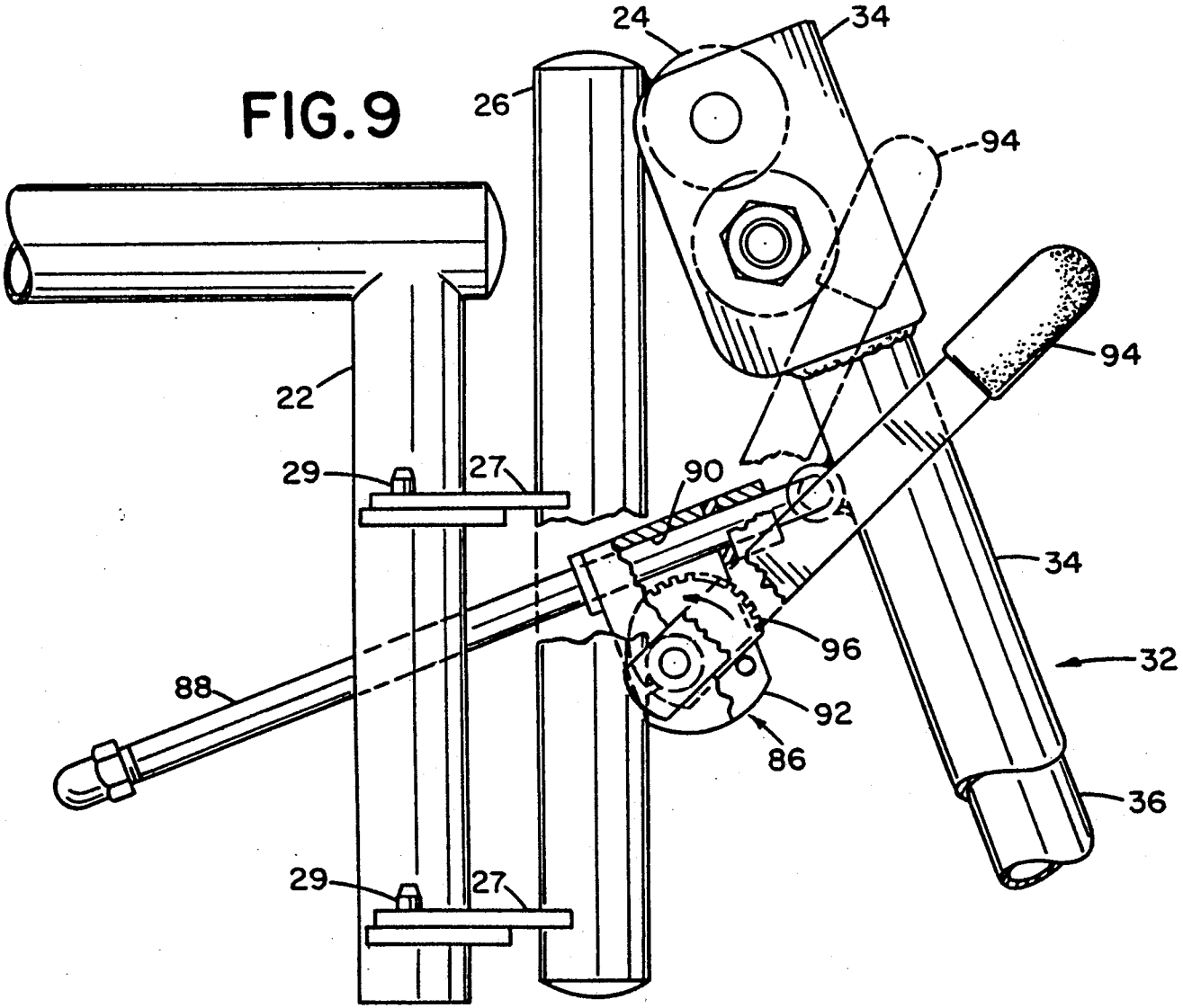
FIG. 9 is a view of the locking mechanism of the leg rest assembly of the present invention.

In accordance with the invention and as shown in FIG. 9, the leg rest assembly of this invention includes a locking mechanism, generally designated by reference numeral 86, which secures strut 32 at any desired angle between the fully lowered and fully elevated positions. Locking mechanism 86 includes cylindrical locking bar 88, which is pivotally connected to upper strut member 34 and is received in bore 90 of housing 92. Housing 92 is pivotally connected to support tube 26. Locking lever 94 is fixed to locking cam 96, which is mounted within housing 92 to pivot about an eccentric axis.

When lever 94 is in the position shown by solid lines in FIG. 9, cam 96 is disengaged from bar 88, and strut 32 can be pivoted freely. When lever 94 is pivoted to the position shown by broken lines in FIG. 9, the edge of cam 96 frictionally engages bar 88 to prevent movement of bar 88 relative to housing 92, which prevents strut 32 from pivoting. The edge of cam 96 preferably has a knurled surface to increase its frictional engagement with rod 88. Locking lever 94 and locking cam 96 preferably are connected by an elongated axle (not shown) which enables lever 94 to be located on the outer side of support tube 26 and cam 96 on the inner side of support tube 26.

The operation of the extending means of this invention now will now be described with reference to FIGS. 2–5.

As seen in FIG. 2, drive link 72 and follower link 78 form two legs of a triangle that is completed by an imaginary line C connecting second gear axis B and the pivotal connection between link 78 and lug 84. The length of line C corresponds closely to the distance between proximal end 32*a* and distal end 32*b* of strut 32. When strut 32 of leg rest assembly 20 is in its lowered position, the angle $\alpha_1$ between drive link 72 and follower link 78 is at a minimum value. Consequently, the distance between proximal end 32*a* and distal end 32*b* of strut 32 is at a minimum. With the strut in its lowered position, the position of mounting bar 53 within lower strut member 38 should be adjusted so that the patient's foot is comfortably supported by foot rest 52.

When strut 32 is raised toward its elevated position, pivoting about first gear axis , second gear member 64 is caused to rotate (counterclockwise as seen in FIGS. 2 and 4) due to its meshing engagement with first gear member 24, which is fixed to support tube 26. The rotation of second gear member 64 causes the rotation of bolt 66 (keyed to gear member 64 by key member 70), which in turn causes drive link 72 (fixed to bolt 66 by welding) to pivot about second gear axis B. As strut 32 is pivoted toward its elevated position, the pivoting of drive link 72 increases the angle between links 72 and 78, which increases the length of line C and extends foot rest 52. When strut 32 is in its fully elevated position, the angle between links 72 and 78 is at its maximum value, $\alpha_2$, the length of line C is at its maximum, and foot rest 52 is fully extended.

The desired amount of foot rest extension will, of course, depend on a number of factors, particularly the size of the patient and the positioning of first gear axis A relative to the patient's knee joint. We have found that, when mounting support tube 26 to the front frame member of conventional wheelchairs, it is desirable to provide an extension of about 4–5 inches for an adult patient. In the configuration shown in the drawings, where the effective lengths (distance between pivot points) of drive link 72 and follower link 78 are 4.5 and 11.0 inches, respectively, an extension of approximately 4.6 inches can be achieved where $\alpha_1$ at the lowered position is approximately 60° and $\alpha_2$ at the fully elevated position is approximately 140°.

Caution should be exercised in setting the dimensions of links 72 and 78 to ensure that angle $\alpha_2$ is less than 180° provide adequate clearance between strut 32 and the links when the strut is in its elevated position. Further clearance is provided by lug 84, which offsets second end 82 of follower link 78 from strut 32. The clearance between strut 32 and links 72 and 78 minimizes the risk that clothing or hands become caught between the strut and links. Another safety feature of the present invention is provided by gear cover 46.

The present invention thus provides a leg rest assembly that automatically extends the foot rest as the leg rest is elevated. The present invention also provides an automatically extendable leg rest having an extending mechanism that avoids the safety hazards of prior art devices.

It will be apparent to those skilled in the art that other modifications and variations can be made in the apparatus of the invention without departing from the scope of the invention. For example, although the extendable strut shown in the drawings comprises a pair of coincident telescoping hollow tubes, the strut also can comprise parallel but non-coincident strut members. In addition, the upper strut member can be configured for mounting and enclosing the first and second gear members, thus eliminating the need for a separate gear cover. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. An extendable elevating leg rest assembly for a wheelchair, comprising:

a. a first gear member having a first gear axis and a plurality of first gear teeth arranged circumferentially around said first gear axis;

b. mounting means for mounting said first gear member on the wheelchair, said mounting means preventing said first gear member from rotating about said first gear axis;

c. an extendable strut pivotable about said first gear axis between a lowered position and an elevated position, said strut including a proximal end pivotally connected to said first gear member;

d. a foot rest connected to said strut at said distal end thereof; and e. extending means, engageable with said first gear member, for extending said foot rest in reaction to said strut being pivoted toward said elevated position.

2. The leg rest assembly of claim 1, wherein said mounting means includes a support tube mountable on the wheelchair.

3. The leg rest assembly of claim 2, wherein said first gear member is fixed to said support tube.

4. The leg rest assembly of claim 3, wherein said first gear member is welded to said support tube.

5. The leg rest assembly of claim 2, wherein said support tube is pivotable relative to the wheelchair about a vertical swing axis.

6. The leg rest assembly of claim 1, wherein said first gear teeth extend around only a first portion of the circumference of said first gear member, said first portion being defined by an arc centered at said first gear axis and measuring less than 360°.

7. The leg rest assembly of claim 6, wherein said arc defining said first portion measures approximately 180°.

8. The leg rest assembly of claim 1, wherein said extending means includes:

a second gear member having a second gear axis and a plurality of second gear teeth arranged circumferentially around said second gear axis, said second gear member being rotatably mounted to said strut proximate said proximal end thereof, said second gear teeth being in meshing engagement with said first gear teeth of said first gear member so that said second gear member rotates about said second gear axis when said strut is pivoted about said first gear axis; and link means connected between said second gear member and said strut for increasing the distance between said proximal end and said distal end of said strut as said strut is pivoted toward said elevated position.

9. The leg rest assembly of claim 8, wherein said link means includes:

a drive link having a fixed end fixed to said second gear member and a free end; and a follower link having a first end pivotally connected to said drive link proximate said free end thereof and a second end pivotally connected to said strut proximate said distal end thereof.

10. The leg rest assembly of claim 9, wherein:

said extending means includes a bolt keyed to said second gear member; and said fixed end of said drive link is fixed to said bolt.

11. The leg rest assembly of claim 9, wherein the distance between said fixed and free ends of said drive link is less than the distance between said first and second ends of said follower link.

12. The leg rest assembly of claim 8, wherein said extendable strut includes a gear cover at said proximal end thereof, said gear cover at least partially enclosing said first and second gear members.

13. The leg rest assembly of claim 12, wherein each of said first and second gear members is pivotally connected to said gear cover.

14. The leg rest assembly of claim 6, wherein said second gear teeth extend around only a second portion of the circumference of said second gear member, said second portion being defined by an arc centered at said second gear axis and measuring less than 360°.

15. The leg rest assembly of claim 14, wherein said arc defining said second portion measures approximately 180°.

16. The leg rest assembly of claim 1, further comprising connecting means for adjustably connecting said foot rest to said distal end of said strut.

17. The leg rest assembly of claim 16, wherein said connecting means includes:

a mounting bar having a first end slidably received in said strut at said distal end thereof and a second end, said foot rest being mounted on said mounting bar proximate said second end thereof; and clamping means for releasably clamping said mounting bar to said strut.

18. An extendable elevating leg rest assembly for a wheelchair, comprising:

a. a first gear member having a first gear axis and a plurality of first gear teeth arranged circumferentially around said first gear axis;

b. mounting means for mounting said first gear member on the wheelchair, said mounting means preventing said first gear member from rotating about said first gear axis;

c. an extendable strut pivotable about said first gear axis between a lowered position and an elevated position, said strut including an upper strut member having a first end pivotally connected to said first gear member and a second end, said strut further including a lower strut member substantially parallel to said upper strut member and having an upper first end and a lower second end, said upper and lower strut members being slidable relative to each other to vary the distance between said first end of said upper strut member and said second end of said lower strut member;

d. a foot rest connected to said lower strut member at said second end thereof; and e. extending means, engageable with said first gear member, for extending said foot rest in reaction to said strut being pivoted toward said elevated position, said extending means including:

a second gear member having a second gear axis and a plurality of second gear teeth arranged circumferentially around said second gear axis, said second gear member being rotatably mounted on said upper strut member proximate said first end thereof, said second gear teeth being in meshing engagement with said first gear teeth of said first gear member so that said second gear member rotates about said second gear axis when said strut is pivoted about said first gear axis, and link means connected between said second gear member and said lower strut member for increasing the distance between said first end of said upper strut member and said second end of said lower strut member as said strut is pivoted toward said elevated position.

19. The leg rest assembly of claim 18, wherein said link means includes:

a drive link having a fixed end fixed to said second gear member and a free end; and a follower link having a first end pivotally connected to said drive link proximate said free end thereof and a second end pivotally connected to said lower strut member proximate said second end thereof.

20. The leg rest assembly of claim 18, wherein said upper strut member includes an open tubular portion at said second end thereof, said first end of said lower strut member being slidably received in said upper strut member through said second end of said upper strut member.

21. An extendable elevating leg rest assembly for a wheelchair, comprising:

a. a support tube mountable on the wheelchair;

b. a first gear member having a first gear axis and a plurality of first gear teeth arranged circumferentially around said first gear axis, said first gear member being fixed to said support tube and prevented from rotating about said first gear axis;

c. an extendable strut pivotable about said first gear axis between a lowered position and an elevated position, said strut including:

a generally U-shaped gear cover pivotally connected to said first gear member, a hollow upper strut member having a first end fixed to said gear cover and an open second end, and a lower strut member having a first end received in said upper strut member through said open second end of said upper strut member and a second end, said upper and lower strut members being slidable relative to each other to vary the distance between said first end of said upper strut member and said second end of said lower strut member;

d. a foot rest connected to said lower strut member at said second end thereof; and e. extending means, engageable with said first gear member, for extending said foot rest in reaction to said strut being pivoted toward said elevated position.

22. The leg rest assembly of claim 21, wherein said extending means includes:

a second gear member having a second gear axis and a plurality of second gear teeth arranged circumferentially around said second gear axis, said second gear member being rotatably mounted to said gear cover such that said second gear teeth are in meshing engagement with said first gear teeth of said first gear member and said second gear member rotates about said second gear axis when said strut is pivoted about said first gear axis;

a drive link having a fixed end fixed to said second gear member and a free end; and a follower link having a first end pivotally connected to said drive link proximate said free end thereof and a second end pivotally connected to said lower strut member proximate said second end thereof.

23. The leg rest assembly of claim 21, further comprising an connecting means for adjustably connecting said foot rest to said second end of said lower strut, said connecting means including:

a mounting bar having a first end slidably received in said second end of said lower strut member and a second end, said foot rest being mounted on said mounting bar proximate said second thereof; and clamping means for releasably clamping said mounting bar to said lower strut member.

24. An extendable elevating leg rest assembly for a wheelchair, comprising:

a. a support tube mountable on the wheelchair;

b. a first gear member having a first gear axis and a plurality of first gear teeth arranged circumferentially around said first gear axis, said first gear member being fixed to said support tube and prevented from rotating about said first gear axis;

c. an extendable strut pivotable about said first gear axis between a lowered position and an elevated position, said strut including a hollow upper strut member having a first end pivotally connected to said first gear member and an open second end, said strut further including a lower strut member having a first end received in said upper strut member through said open second end of said upper strut member and an open second end, said upper and lower strut members being slidable relative to each other to vary the distance between said first end of said upper strut member and said second end of said lower strut member;

d. an adjustable foot rest assembly including:

a mounting bar having a first end slidably received in said open second end of said lower strut member and a second end, a foot rest mounted on said mounting bar proximate said second end thereof, and clamping means for releasably clamping said mounting bar to said lower strut member; and e. extending means, engageable with said first gear member, for extending said foot rest in reaction to said strut being pivoted toward said elevated position, said extending means including:

a second gear member having a second gear axis and a plurality of second gear teeth arranged circumferentially around said second gear axis, said second gear member being rotatably mounted on said upper strut member proximate said first end thereof, said second gear teeth being in meshing engagement with said first gear teeth of said first gear member so that said second gear member rotates about said second gear axis when said strut is pivoted about said first gear axis, a drive link having a fixed and fixed to said second gear member and a free end, and a follower link having a first end pivotally connected to said drive link proximate said free end thereof and a second end pivotally connected to said lower strut member proximate said second end thereof.

25. A wheelchair, comprising a frame, a pair of rear wheels connected to said frame, a pair of front wheels connected to said frame, and at least one extendable elevating leg rest assembly, said leg rest assembly including:

a. a first gear member having a first gear axis and a plurality of first gear teeth arranged circumferentially around said first gear axis;

b. mounting means for mounting said first gear member on said frame, said mounting means preventing said first gear member from rotating about said first gear axis;

c. an extendable strut pivotable about said first gear axis between a lowered position and an elevated position, said strut including a proximal end pivotally connected to said first gear member;

d. a foot rest connected to said strut at said distal end thereof; and e. extending means, engageable with said first gear member, for extending said foot rest in reaction to said strut being pivoted toward said elevated position.

26. A wheelchair, comprising a frame, a pair of rear wheels connected to said frame, a pair of front wheels connected to said frame, and at least one extendable elevating leg rest assembly, said leg rest assembly including:

a. a support tube mountable on said frame;

b. a first gear member having a first gear axis and a plurality of first gear teeth arranged circumferentially around said first gear axis, said first gear member being fixed to said support tube so that said first gear axis is disposed horizontally and said first gear member is prevented from rotating about said first gear axis;

c. an extendable strut including:

a generally U-shaped gear cover pivotally connected to said first gear member to permit pivoting of said strut about said first gear axis between a lowered position and an elevated position, a hollow upper strut member having a first end fixed to said gear cover and an open second end, and a lower strut member having a first end received in said upper strut member through said open second end of said upper strut member and a second end, said upper and lower strut members being slidable relative to each other to vary the distance between said first end of said upper strut member and said second end of said lower strut member;

d. a foot rest assembly connected to said second end of said lower strut member; and e. extending means, engageable with said first gear member, for extending said foot rest in reaction to said strut being pivoted toward said elevated position, said extending means including:

a second gear member having a horizontal second gear axis and a plurality of second gear teeth arranged circumferentially around said second gear axis, said second gear member being rotatably mounted to said gear cover such that said second gear teeth are in meshing engagement with said first gear teeth of said first gear member and said second gear member rotates about said second gear axis when said strut is pivoted about said first gear axis, a drive link having a fixed end fixed to said second gear member and a free end, and a follower link having a first end pivotally connected to said drive link proximate said free end thereof and a second end pivotally connected to said lower strut member proximate said second end thereof.

* * * * *